United States Patent [19]

Borg et al.

[11] 4,292,772

[45] Oct. 6, 1981

[54] TRAILER MOUNTED HIGH FLOOR DRILLING MAST AND SUBSTRUCTURE ARRANGEMENT

[75] Inventors: Paul E. Borg; Terry M. Lechinger, both of Houston, Tex.

[73] Assignee: PRE Corporation, Houston, Tex.

[21] Appl. No.: 111,915

[22] Filed: Jan. 14, 1980

[51] Int. Cl.[3] ..... B66B 23/06

[52] U.S. Cl. ..... 52/118; 52/120

[58] Field of Search ..... 52/116, 120, 118; 173/151

[56] References Cited

U.S. PATENT DOCUMENTS

| | | | |
|---|---|---|---|
| 2,993,570 | 7/1961 | Bender | 52/118 |
| 3,802,137 | 4/1974 | Armstrong | 52/118 |
| 3,803,780 | 4/1974 | Donnally | 52/116 |
| 3,922,825 | 12/1975 | Eddy et al. | 52/116 |
| 4,138,805 | 2/1979 | Patterson | 52/118 |
| 4,221,088 | 9/1980 | Patterson | 52/116 |

FOREIGN PATENT DOCUMENTS

| | | | |
|---|---|---|---|
| 554672 | 3/1958 | Canada | 52/120 |

*Primary Examiner*—Carl D. Friedman
*Attorney, Agent, or Firm*—Jack W. Hayden

[57] ABSTRACT

Telescopable drilling mast means is transportable on and pivotally connected to a first trailer means. Setback tower means is pivotally connected to the drilling mast means and to the first trailer means.

Second trailer means are provided with elevatable drawworks support means with drawworks, power source and rotary table thereon which elevatable drawworks support means is transportable on and pivotally mounted on the second trailer means.

Means secure the first and second trailer means in end to end relation to position the drawworks support means and drilling mast means in longitudinal alignment, and load bearing means support the first and second trailer means in position on the earth's surface. Lifting frame means is connected to the drilling mast means and positionable to extend upwardly therefrom whereby the drilling mast means, and setback tower means may be simultaneously elevated from a reclined position to an upright position on the first trailer means by cable means having one end secured to the lifting frame means and then extending over sheave means mounted on the drawworks support means and over sheave means at one end of the lifting frame means and around sheave means on the drilling mast means to be connected with the travelling block of the drilling mast. Cable means extend from the drawworks and over the crown block of the drilling mast to the travelling block to effect raising thereof.

1 Claim, 3 Drawing Figures

TRAILER MOUNTED HIGH FLOOR DRILLING MAST AND SUBSTRUCTURE ARRANGEMENT

CROSS REFERENCE TO RELATED APPLICATION

The present invention relates to an alternate form of the invention of application Ser. No. 000,441 filed Jan. 2, 1979, and assigned to the assignee of this invention. So far as known to applicants, this copending application represents the closest prior art.

SUMMARY OF THE INVENTION

Various types of high floor, elevatable drilling mast, setback tower means and drawwork means have been provided in the prior art. Generally speaking, such prior art arrangements require use of an A-frame or a crane for elevation of the drilling mast to an upright position. In some instances the A-frame serves as support for the elevated drilling mast to maintain it in an upright position and the A-frame may hinder or interfere with the proper positioning of the elevatable drawworks, thereby restricting the amount of working area available.

In some instances it is desirable to provide a telescoping mast on a trailing means so that it may be readily transported from one location to the other. A drawworks support means on another trailer means is thereafter aligned in end to end relation with the trailer on which the telescoping mast is carried so that the mast and drawworks may be elevated to an upright operating position.

An object of the present invention is to provide an arrangement whereby a drilling mast may be mounted and transported on suitable trailer means along with a setback tower means, as well as a second trailer means having a drawworks support pivotally mounted thereon with a drawworks, power source and rotary table on the support so that the two trailer means may be secured together in end to end relationship at a well location and the drilling mast then elevated to an upright position. Thereafter the drawworks support, with the drawworks, power source and rotary table thereon may be elevated to an upright position adjacent the upright mast.

The elevation of the upright mast is accomplished without the use of an A-frame or crane, but by means of lifting frame means which may be pivotally connected adjacent the lower end of the drilling mast and thereafter positioned and retained in such position by cable means so as to extend upwardly and laterally from the drilling mast. Suitable cable means are connected adjacent the outermost end of the upwardly extending lifting frame means and extends downwardly and around sheave means on the drawworks support means, then over sheave means on the end of the upwardly extending frame means and then under sheave means in the reclined mast and is connected with the hook in the travelling block in the drilling mast. Cable means extend from the travelling block, over the crown block in the drilling mast to the drawworks whereupon rotation of the drawworks effects elevation of the mast to an upright position.

Another object of the present invention is to provide a high floor elevatable mast which is transportable on a trailer means and a drawworks support and drawworks transportable on another trailer means which elevatable mast and drawworks support means with drawworks, power source and rotary table may be elevated to an upright position without the use of an A-frame and which trailer mounted mast and drawworks support may be secured together to retain them in an upright position with the remainder of any pin connections and structure that may be required being accomplished from substantially adjacent ground level.

Other objects and advantages of the present invention will become apparent from a consideration of the following drawings and description.

DESCRIPTION OF THE PREFERRED EMBODIMENT

Figure 1:
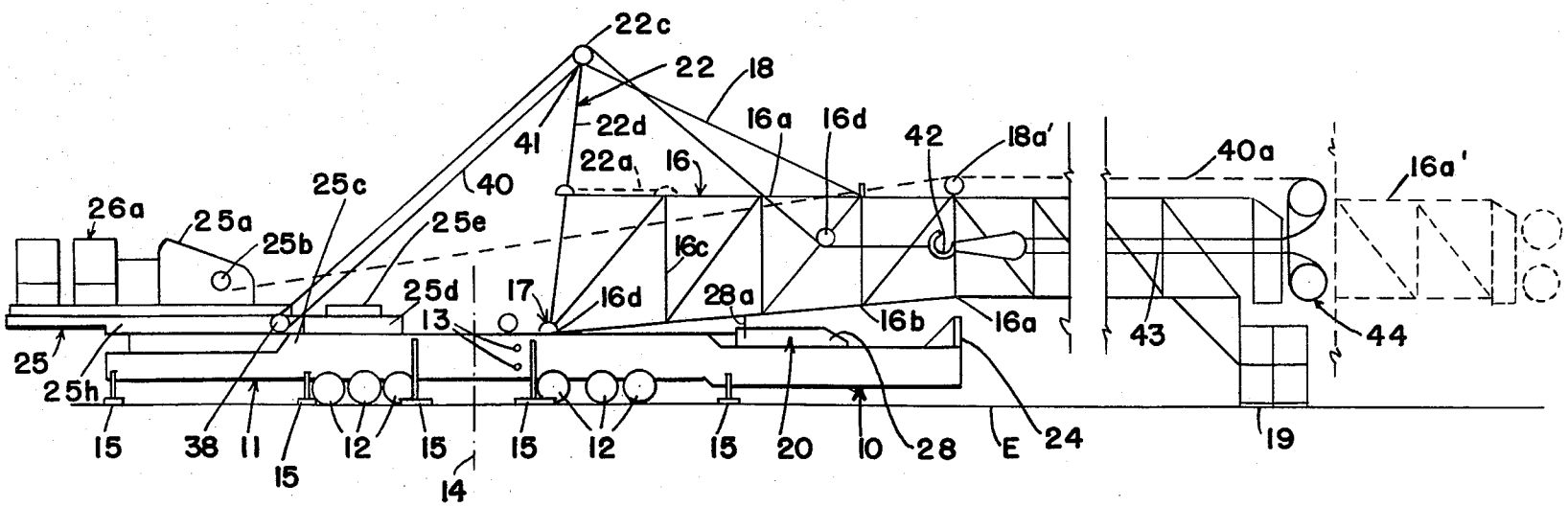
FIG. 1 is a side schematic view illustrating a drilling mast and setback tower pivotally secured and in reclined position on a trailer means with a drawworks support and drawworks thereon pivotally carried by another trailer means which trailer means are secured together in end to end relation to position the drawworks support means and drilling mast means in longitudinal alignment.

Attention is first directed to FIG. 1 of the drawings wherein a first trailer means is represented generally by the numeral 10. A second trailer means is represented generally by the numeral 11. Each trailer means 10 and 11 is provided with suitable wheels as shown at 12 whereby each trailer means and the respective portion of the present invention carried thereby may be moved over the earth's surface by any suitable vehicle means and then positioned in end to end relation as illustrated in FIG. 1 of the drawings.

After the trailers 10 and 11 have been positioned in end to end relation as shown in FIG. 1, suitable pin means represented at 13 may be employed to connect the trailer means 10 and 11 together and secure them in end to end relation and in proper relation to the center line of the well represented by the line designated 14. Also, suitable jack means (not shown) may be used to level the trailer means 10 and 11 in the desired operating position and relationship whereupon bearing pads of any suitable configuration and as illustrated at 15 may be employed on each trailer means 10 and 11 and secured thereto in any suitable well known manner so as to abut the adjacent earth's surface represented by the letter E whereby the drilling load from the mast 16 and setback structure 20 is transmitted to the earth's surface E through such bearing pad means 15 to thus allievate any load on the wheels 12 of each trailer means 10 and 11.

A drilling mast illustrated generally at 16 is pivotally supported at one end of each side as generally illustrated at 17 on the first trailer means 10. Setback tower means referred to generally at 20 is pivotally connected to the mast 16 and the first trailer means 10 as will be described in greater detail hereinafter.

Lifting frame means referred to generally by the numeral 22 is pivotally connected to the mast 16 and when the mast 16 is reclined on the first trailer means, the lifting frame means 22 will assume the position referred to in dotted line at 22*a* in FIG. 1. When it is desired to elevate the mast 16, the lifting frame means 22 is moved upwardly to the solid position shown in FIG. 1 and retained in such upwardly and laterally extending position in relation to the mast 16 by means of the back stay line 18 connected adjacent the outer upwardly extending end of the lifting frame means 22 and the mast 16 as shown in FIG. 1. Lifting frame means 22 is provided on each side adjacent the end of the mast 16 as shown in the drawings.

The mast 16 may be of any suitable type and may comprise telescoping sections. If the mast 16 is formed, by way of example, of three telescoping sections, it may be extended its full extent as illustrated at dotted line portion 16*a*' by the vehicle means which positions the first trailer means 10 on location. Thereafter the pipe racking platform illustrated at 19 may be secured in position on the drilling mast 16.

The second trailer means 11 has pivotally supported thereon an elevatable drawworks support arrangement referred to generally by the numeral 25. Carried on the pivotally mounted drawworks support 25 is the drawworks 25*a* and suitable power source referred to generally at 26*a*. The drawworks 25*a* includes a drum 25*b* on which suitable cable means is provided. Also the forward end 25*c* of the drawworks support is provided with rotary table support beam 25*d* which carry and support the rotary table 25*e* thereon.

It can be appreciated that the trailer means 10 and 11 is of a suitable construction to accommodate the loads involved not only in trasporting the mast support means and drilling mast, as well as the drawworks support and drawworks, but such trailer means 10 and 11 is also of suitable structural design and arrangement to support the loads involved during drilling an oil, gas well and the like. The drilling mast referred to at 16 is a quadrilateral, and is preferably a generally rectangular frame structure formed in any suitable manner and as shown it includes longitudinally extending and laterally spaced members 16*a* on one side and similarly arranged members 16*b* on the other side with suitable laterally extending brace members 16*c* extending therebetween. However, one side, side 16*a* of the mast is open and it faces towards the first trailer means 10 when the mast 16 is reclined thereon. The open face 16*a* faces the setback structure 20 when the mast 16 and setback structure 20 is elevated and enables pipe to be transferred between the mast 16 and the setback tower 20 for racking as desired.

The pair of members 16*b* forming one side of the mast means 16 is pivotally connected at one of their ends 16*d* to the first trailer means 10 by the lower end of such legs being pinned by suitable means to the mast footing 17 on each side of the trailer means 10. When the mast 16 is reclined on the first trailer means 10 as shown in FIG. 1, the legs 16*a* of the means are elevated as shown above the bed of the first trailer means 10 and in relation to the legs 16*b* laterally spaced therefrom.

The setback tower means 20 includes a surface portion 28 which forms an upper floor surface when the setback tower 20 is elevated to an upright position on the first trailer means 10. One end of the surface portion 28 forming a part of the setback tower means 20 is pivotally connected as shown at 28*a* to the mast means, and the other end of the setback tower 20 is pivotally connected to the first trailer means by means of the pair of laterally spaced and braced beams 28 which are pivotally connected at one end 29*a* adjacent the surface portion 28 and at their other or lower ends 29*b* to the first trailer means 10 as more clearly illustrated in FIGS. 2 and 3 of the drawings.

Spaced longitudinally of the setback tower means 20 and mounted on the first trailer means 10 is a suitable support structure 24 for engaging the legs 16*b* of the drilling mast to position it on the trailer means when the mast is reclined during movement of the trailer 10 and the drilling mast 16 and setback tower 20 from one location to another.

The lifting frame means 22 comprises beams 22*d* on each side of, or adjacent the ends of each of the longitudinal legs 16*a* of the mast 16. The lower end of each beam 22*d* is pivotally connected adjacent the end of each leg 16*a* to enable the beams to be rotated in the position represented by the numeral 22*a* shown in dotted line position in FIG. 1 of the drawings when not in use, and to enable the beams 22*d* to be moved to their raised position for use.

When the two beams 22*d* are elevated to the full line position of FIG. 1, they may be secured in such operating position by the back stay line 18 so that they extend upwardly and laterally from the mast 16 as shown in FIG. 1.

The elevatable drawworks support means 25 includes structure forming four longitudinally extending legs when the elevatable drawworks support means is reclined as shown in FIG. 1. Of course, such elevatable drawworks support means 25 also includes a support surface 25*h* for receiving the drawworks 25*a* and power source 26*a*. The four longitudinally extending legs are better seen in FIG. 3 of the drawings where two of such legs represented by the numeral 30 and 31 are shown. It can be appreciated that two indentical such legs or beams are provided on the other side of the second trailer means 11. The beams 30, 31 are pivotally connected at their lower ends 30*a* and 31*a* respectively to the second trailer means 11 and are pivotally connected at their other or opposite ends to the support floor 25*h* for the drawworks 25*a* and the power source 26*a*.

After the first and second trailer means 10 and 11 have been positioned relative to the well site represented by the numeral 14 in FIG. 1, and secured together by the connection means 13, it is then desirable to elevate the mast and the drawworks support, to an upright position and secure them together so that drilling operations may be carried out.

To accomplish this, sheave means 38 are provided on the second trailer means 11, and as shown are provided on the reclined elevatable drawworks support 25 in FIG. 1. Similarly sheave means 22*c* are provided at the upper end of each of the laterally spaced beams 22*d* and sheave means 16*d* are provided in the mast 16 as illustrated. It can be understood that a separate sheave means is provided on the end of each beam 22*d*, and a sheave means 38 is provided on each side of the drawworks support 25 for receiving separate cable means which extend over each of the sheave means 22*c* on each of the beam members 22*d*, as will be described.

Figure 2:
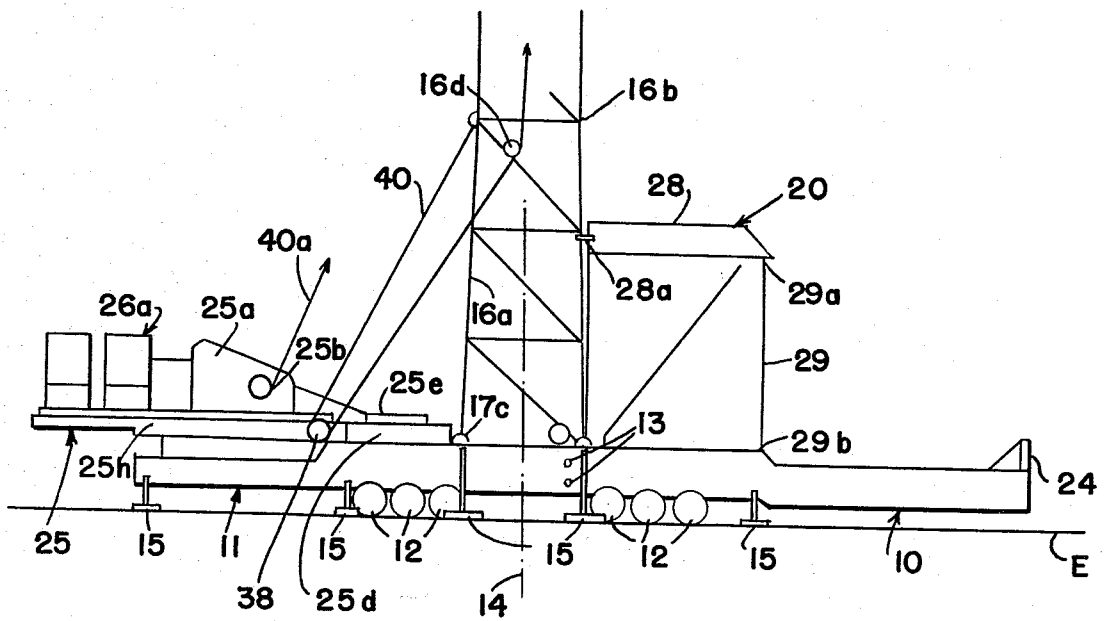
FIG. 2 illustrates the drill mast means, and setback tower means in elevated, upright position, with cable means connected in position to next raise the elevatable drawworks support with the drawworks, power source and rotary table thereon to an elevated position adjacent the drilling mast for securing thereto.

For example, a cable 40 is shown as being secured at one end 41 adjacent the upper end of the beams 22*d*. It can be understood that a separate cable is connected at each of the upper ends of each of the beams 22*d*. Each cable 40 extends downwardly underneath its respective sheave means 38 on each side of the drawworks support means 25 and then over the sheave 22*c* on the upper end of the beams 22*d*, and then underneath the sheaves 16*d* generally aligned therewith in the mast 16 and each cable 40 is connected to the travelling block hook 42. The travelling block hook is supported by cable means 43 that extend upwardly and over the crown block represented generally at 44 with one of such cable means extending as indicated at 40*a* over the crown block 44, over the sheave means 18*a'* on the mast 16 and back to the drum 25*b* of the drawworks. Thus, after the mast 16 has been extended by the vehicle described previously, the mast 16 may then be elevated from its reclined position shown in FIG. 1 to the upright position as shown in FIG. 2 of the drawings by rotation of the drum 25*b* to pull on the cable 40*a*. When the drilling mast 16 is upright, the legs 16*a* may be pinned to the footings 17*c* and thus the mast 16 positioned and maintained in an upright relationship.

Figure 3:
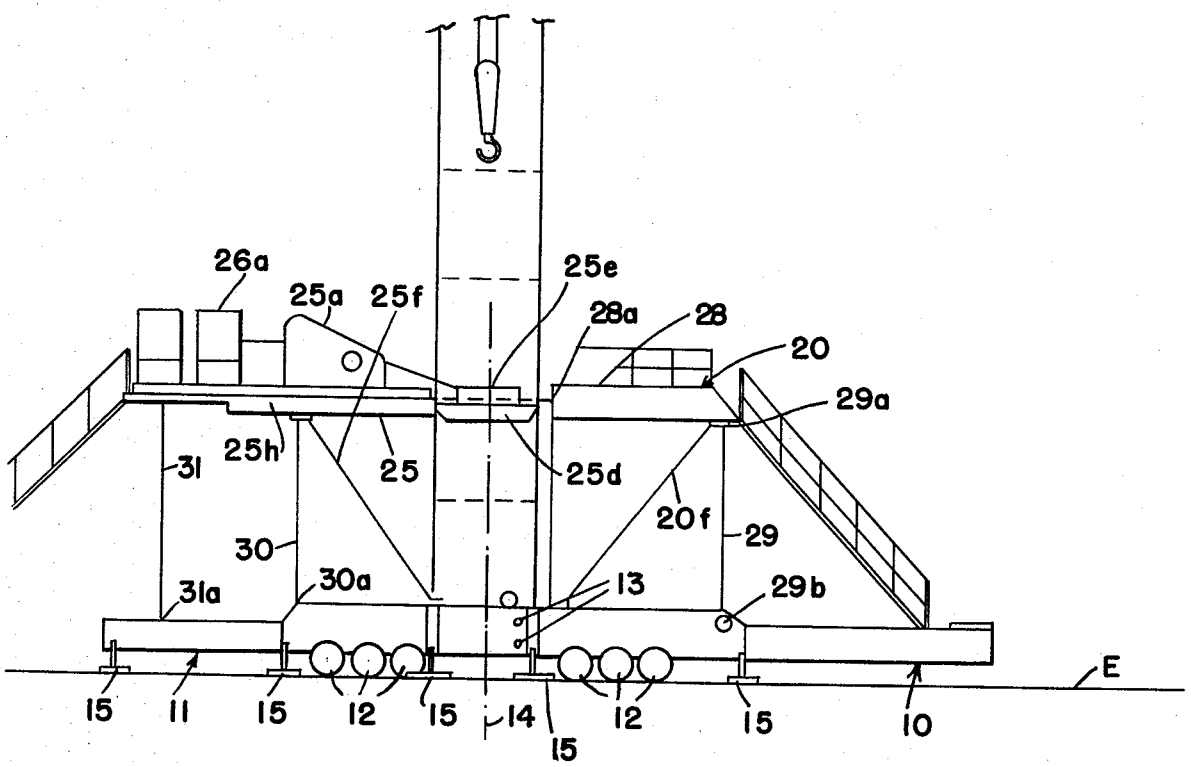
FIG. 3 illustrates the drilling mast and drawworks in upright position along with the setback tower on their respective trailer means to enable drilling operations to be conducted.

Thereafter, the cables 40 are extended down and around the sheave means 38 on each side of the drawworks support 25 and then under the pair of sheaves 16*d* in the drilling mast 16 as illustrated in FIG. 2. The cable 40 then extends upwardly to connect to the hook on the travelling block represented at 42 in FIG. 1. The cables 43 from the travelling block extend over the crown block 44 as described with regard to raising the mast and shown in FIG. 1. One of the cable means 43 as represented at 40*a* in FIG. 2, extend from the crown block and connect to the drum 25*b* on the drawworks 25*a*. The drawworks 25*a* may then be actuated to rotate drum 25*b* and as the cable 40*a* is reeled in, the drawworks support 25 as well as the drawworks 25*a* and power source 26*a* supported thereon and the rotary table 25*e* on beams 25*d* are elevated to the position illustrated in FIG. 3. Thereupon the ends of the legs 30 and 31 may be secured in a non pivotal relationship to the trailer 11 and at their upper ends to the drawworks support 25 as desired. The rotary table 25*e* and support beams 25*d* extend between the legs of the drilling mast and the beams 25*d* are connected to the setback tower 20 when elevated as shown in FIG. 3. Thereafter the setback tower 20 may be braced by suitable means such as the brace 20*f* and the drawworks support may be braced by the brace 25*f* as shown in FIG. 3.

From the foregoing description it can be appreciated that the drilling mast 16 as well as the drawworks 25*a* may be moved from their respective trailer supported positions to an upright elevated position without the use of an A-frame and then positioned together so as to conduct drilling operations.

When drilling operations have been completed, the raising procedure may be reversed whereupon the trailer means 10 and 11 may be disengaged and the mast and drawworks then separately moved to a new location and repositioned where the operation may then be repeated.

The foregoing disclosure and description of the invention are illustrative and explanatory thereof, and various changes in the size, shape, and materials as well as in the details of the illustrated construction may be made without departing from the spirit of the invention.

What is claimed is:

1. A trailer mounted high floor telescopable drilling mast and substructure arrangement comprising:

a. first trailer means;

b. telescoping drilling mast means pivotally connected to and transportable in reclined position on said first trailer means;

c. setback tower means pivotally connected to said drilling mast means and to said first trailer means;

d. said drilling mast means comprising a rectangular framed structure having four sides with one of said sides having an open face and which when in reclined position on said first trailer means has said open face side supported in part by said setback tower means on said first trailer means and another of said sides laterally spaced and elevated in relation to said first trailer means;

e. second trailer means;

f. elevatable drawworks support means with drawworks, power source and rotary table thereon pivotally mounted and transportable on said second trailer means;

g. means to secure said first and second trailer means in end to end relation to position said drawworks support means and drilling mast means in longitudinal alignment;

h. load bearing means to support said first and second trailer means in position;

i. lifting frame means connected to said drilling mast means; and j. cable means extending between said lifting frame means and drilling mast means to retain said lifting frame means in laterally and upwardly extending relation to said drilling mast means when lifting cable means are connected to said lifting frame means to simultaneously elevate said drilling mast means and setback tower means from a reclined position to an upright position on said first trailer means.

* * * * *